US009004143B2

(12) United States Patent
Wilson

(10) Patent No.: US 9,004,143 B2
(45) Date of Patent: Apr. 14, 2015

(54) BLINDS-BETWEEN-GLASS WINDOW WITH THERMAL BREAK

(71) Applicant: Medieval Glass Millennium Ltd., Delta (CA)

(72) Inventor: Michael A. Wilson, Vancouver (CA)

(73) Assignee: Medieval Glass Millennium Ltd. (CA)

( * ) Notice: Subject to any disclaimer, the term of this patent is extended or adjusted under 35 U.S.C. 154(b) by 0 days.

(21) Appl. No.: 13/761,959

(22) Filed: Feb. 7, 2013

(65) Prior Publication Data

US 2013/0199737 A1 Aug. 8, 2013

Related U.S. Application Data

(60) Provisional application No. 61/596,029, filed on Feb. 7, 2012.

(51) Int. Cl.

| | |
|---|---|
| ***E06B 3/32*** | (2006.01) |
| ***E06B 9/264*** | (2006.01) |
| ***E06B 3/67*** | (2006.01) |

(52) U.S. Cl.

CPC ..... *E06B 9/264* (2013.01); *E06B 3/6715* (2013.01); *E06B 2009/2646* (2013.01)

(58) Field of Classification Search

USPC ..... 160/107, 168.1 R, 172 R; 49/61–65

See application file for complete search history.

(56) References Cited

U.S. PATENT DOCUMENTS

| | | | | |
|---|---|---|---|---|
| 4,369,828 | A * | 1/1983 | Tatro | 160/107 |
| 5,226,466 | A * | 7/1993 | Coddens | 160/107 |
| 5,699,845 | A * | 12/1997 | Jelic | 160/107 |
| 6,601,633 | B2 * | 8/2003 | Sun et al. | 160/107 |
| 8,499,815 | B2 * | 8/2013 | Zhang | 160/176.1 R |
| 2003/0066614 | A1 * | 4/2003 | Sun et al. | 160/107 |
| 2006/0118250 | A1 * | 6/2006 | Jin et al. | 160/107 |
| 2008/0029226 | A1 * | 2/2008 | Huang | 160/107 |
| 2008/0083511 | A1 * | 4/2008 | Hung | 160/168.1 R |
| 2012/0118514 | A1 * | 5/2012 | Hughes | 160/25 |
| 2013/0075048 | A1 * | 3/2013 | Berger | 160/107 |
| 2013/0292066 | A1 * | 11/2013 | Draper | 160/107 |

* cited by examiner

*Primary Examiner* — Katherine Mitchell
*Assistant Examiner* — Scott Denion
(74) *Attorney, Agent, or Firm* — McKee, Voorhees & Sease, P.L.C.

(57) ABSTRACT

A blinds-between-glass window assembly includes spacers with a thermal break. The assembly is modular in that the same components can be used to form window assemblies of varying thicknesses by replacement of the corner keys. A spring counter-balance mechanism is mounted within a side rail to provide a counter-balancing force against a magnetic follower. Guards are disclosed to reduce scratching or marring that can occur if the blind slats bump against the frame or glass.

9 Claims, 5 Drawing Sheets

BLINDS-BETWEEN-GLASS WINDOW WITH THERMAL BREAK

CROSS-REFERENCE TO RELATED APPLICATIONS

This application claims priority under 35 U.S.C. §120 to provisional application Ser. No. 61/596,029 filed Feb. 7, 2012, herein incorporated by reference in its entirety.

BACKGROUND OF THE INVENTION

The present invention relates to insulated windows, and more specifically, to blinds-between-glass window assemblies and components.

Insulated glass windows with blinds-between-glass are well known in the art. Essentially, such windows include a blind assembly sealed between glass panels. The blinds include a plurality of slats, cords for raising and moving the slats, and operators for controlling the cords. It is also known to use magnetic operators. Each operator slides on the exterior surface of the glass and is magnetically connected to a follower within the insulated glass. The operators remain in position because of the magnetic force. An example of these magnetic operators may be seen in U.S. Pat. No. 5,699,845 to Jelic.

Insulated glass windows have increased in complexity. According to one common construction, two glass panels are separated by perimeter spacers. Desiccant combinations and the inclusion of inert gases such as Argon or Krypton can be used inside the windows to resist heat transfer and prevent condensation on the interior of the windows. A wide variety of many perimeter sealing materials can be used to maintain the insulating gases and desiccant between the glass panels and to keep ambient air and moisture out. Glass surface variations abound, such as low E glass, polycarbonate for institutional uses, laminated glass for Hurricane codes, and tempered glass in differing thickness depending on installation requirements. One issue facing known constructions is the transfer of heat across the structure through the spacers.

The overall thickness of the windows can vary depending upon the energy and space requirements. This can create difficulties for manufacturers who are required to make different components for each different thickness.

The blinds occasionally need to be supported in an open position so their own weight doesn't cause them to drop, particularly in active installations such doors or patio sliders. This can be difficult as the unit size or the width of a glass pane grows, increasing the resistance and internal weight of the blind. Furthermore, it can make it more likely for the operator to break away from the magnetic attraction of the follower during adjustment due to the increased resistance of a heavier blind. If the operator becomes separated from the follower, then the follower is free to move independently of the operator, for example permitting the blinds to drop quickly to the closed position. This can cause the cords to become tangled making the blinds completely or partially inoperable. Even if the cords do not tangle, the force of the drop may wedge the follower so that the operator is unable to move the follower, preventing the opening or closing of the blinds.

Methods to resolve the separation of the operator and follower to date have included internal counter weight, increased magnet force, and a gear and track rail. These methods have achieved varying degrees of success, but all increase cost and are difficult to equate to varying sizes, glass thickness and ease of operation.

Another difficulty is caused by the lateral movements of the blinds, especially in active installations such as doors that can cause the ends of the slats to mar the perimeter spacer and/or glass surface. Some glass surfaces such as low E and polycarbonate are more prone to scratching than tempered float glass.

Insulated glass blind assemblies contain many pieces, which can make assembly difficult. One such part allows the cords to change from the vertical direction associated with the follower and operator to the horizontal direction in the top rail. Typically, this part is a pulley or a curved piece of plastic with a groove or eyelet fixed just inside the corner key of the insulated glass spacer. A pulley overcomes the friction and wear problems, but is difficult to install or assemble. With either type of part, the assembler must thread the cords through the part during manufacture or assembly of the blind and tie them to the internal carriage. When installing blinds into the insulated glass, adjustments need to be made to ensure the blinds are evenly horizontal. This may require frequent operation of the blinds to make cord adjustments, which can be hampered by the closed structure of the spacers that separate the glass panels.

Accordingly, it is an object of the present invention to provide a blinds-between-glass window that utilizes a magnetic operator and follower construction with decreased tendency of the operator and follower to become separated.

It is yet another object of the present invention to provide a blinds-between-glass window that reduces the heat transfer across the window through the spacers.

It is another object of the present invention to provide a blinds-between-glass window that reduces marring of the spacers and inner glass surfaces caused by movement of the blinds.

It is still another object of the present invention to provide a blinds-between-glass window kit that permits better access to the cords and hardware during assembly of the window.

It is another object of the present invention to provide a blinds-between-glass window with spacers that can be utilized in windows with different thicknesses.

These and other objectives become apparent from the following description of the invention.

SUMMARY OF THE INVENTION

According to one embodiment, the present invention is directed to a window assembly that includes a first glass panel, a second glass panel, and a first side rail assembly. The side rail assembly includes an interior spacer plate fixed to the first glass panel, an exterior spacer plate fixed to the second glass panel, and a first clip connecting the interior spacer plate to the exterior spacer plate such that the interior and exterior spacer plates are held apart from each other without direct thermally conductive contact between the spacer plates. The window assembly may also include a second side rail assembly spaced part from and generally parallel to the first side rail assembly. The second side rail assembly may include a second interior spacer plate fixed to the first glass panel, and a second exterior spacer plate fixed to the second glass panel. The window assembly may also include a top rail assembly, a bottom rail assembly, and a second, a third and a fourth connecting clip. The third and fourth connecting clips may hold the second interior spacer plate apart from the second exterior spacer plate such that they are not in direct thermally conductive contact with each other. The first connecting clip may connect the first side rail assembly to the top rail assembly. The second connecting clip may connect the first side rail assembly to the bottom rail assembly. The third connecting clip may connect the second side rail assembly to the top rail assembly. The fourth connecting clip may connect the second side rail assembly to the bottom rail assembly. A blind assembly may be operably attached to the top rail assembly between the glass panels. A magnetic follower may be provided within the first side rail assembly between the interior spacer plate and the exterior spacer plate with a cord connecting the magnetic follower to the blind assembly such that movement of the magnetic follower causes adjustment of the blind assembly. A magnetic operator may slidably engage the first glass panel with the magnetic operator being magnetically coupled to the magnetic follower. A spring holder may be mounted within the first side rail with a spring mounted to the spring holder. The spring may be connected to the follower carriage with the spring being biased to urge the follower carriage away from the cord. A distance between the first glass panel and the second glass panel may be dependent upon a width of the first connecting clip.

According to another embodiment, the present invention is related to window assembly that includes a frame assembly having an operating-side rail, a non-operating-side rail, a top rail and a bottom rail. The operating-side rail is connected to the top rail by a first corner clip and is connected to the bottom rail by a second corner clip. The non-operating-side rail is connected to the top rail by a third corner clip is being connected to the bottom rail by a fourth corner clip. An interior glass panel is mounted to the frame assembly at an interior side of the frame assembly. An exterior glass panel mounted to the frame assembly at an exterior side of the frame assembly opposite from the interior side. A blind assembly is operably attached to the top rail between the glass panels. A follower carriage is retained within the operating-side rail, the follower carriage being operably connected to the blind assembly such that movement of the follower carriage within the operating-side rail in a first direction causes adjustment of the blind assembly towards an open configuration and movement of the follower carriage within the operating-side rail in a second direction causes adjustment of the blind assembly towards a closed configuration. An operator is magnetically coupled to the follower carriage at the interior glass panel, whereby movement of the operator causes corresponding movement of the follower carriage. The operating-side rail includes an operating-side exterior spacer plate and an operating-side interior spacer plate, the operating-side interior spacer plate being held apart from the operating-side exterior spacer plate by the first and second corner clips whereby the operating-side interior spacer plate is not in direct thermally conductive contact with the operating-side exterior spacer plate. The non-operating-side rail includes a non-operating-side exterior spacer plate and a non-operating-side interior spacer plate, the non-operating-side interior spacer plate being held apart from the non-operating-side exterior spacer plate by the third and fourth corner clips whereby the non-operating-side interior spacer plate is not in direct thermally conductive contact with the non-operating-side exterior spacer plate. The window assembly may further include a spring holder mounted within the operating-side rail and a spring mourned to the spring holder with the spring being connected to the follower carriage, to urge the follower carriage towards the first direction. The operating-side interior spacer plate may include an inner lip, an intermediate lip, and an outer lip that each extend generally perpendicularly from an operating-side interior spacer plate base plate. A first channel may be formed by the outer lip, the base plate, and the intermediate lip, and a second channel may be formed by the intermediate lip, the base plate, and the inner lip. The spring holder may include a spring holder base mounted within the first channel and a spring holder body that extends into the second channel through a notch in the intermediate lip. The spring, holder may include a spring, holder body with an axle and a coil spring mounted to the axle. The coil spring may urge the follower carriage downwardly to counterbalance an upward force against the follower carriage caused by a cord connected to the blind assembly. A first guard member may be connected at an inner edge of the operating-side exterior spacer plate between the operating side exterior spacer plate and the blind assembly to prevent the blind assembly from directly contacting the operating side exterior spacer plate. A second guard member may be connected at an inner edge of the non-operating-side exterior spacer plate between the non-operating side exterior spacer plate and the blind assembly to prevent the blind assembly from directly contacting the non-operating side exterior spacer plate. The interior glass panel and the exterior glass panel may extend outwardly beyond an outer perimeter of the frame assembly, and the window assembly may farther include a perimeter seal that completely covers and seals the outer perimeter of the frame assembly and is between the interior and exterior glass panels.

According to yet another embodiment, the present invention is a window assembly that includes an exterior glass panel, an interior glass panel, and a frame assembly. The frame assembly forms a rectangular frame with an outer perimeter and an inner perimeter. The glass panels are fixed to opposite sides of the frame assembly. A blind assembly is operably attached to the frame assembly between the glass panels and is contained within the inner perimeter of the frame. An insert is attached to the frame assembly between the inner perimeter of the frame and the blind assembly to prevent the blind assembly from directly contacting the inner perimeter of the frame. The insert may be located between the blind assembly and the exterior glass panel to prevent the blind assembly from directly contacting the exterior glass panel.

According to another embodiment, the present invention is a blinds-between-glass window assembly that has a frame. The frame includes an operating-side rail, a non-operating-side rail, a top rail, and a bottom rail. An interior glass panel mounted is at one side of the frame, and an exterior glass panel spaced apart from the interior-side glass panel is mounted at an opposite side of the frame such that an insulated space is provided between the glass panels. A blind assembly is operationally mounted to the frame within the insulating space. A follower carriage is provided within the operating-side rail operably connected to the blind assembly such that movement of the follower carriage causes adjustment of the blind assembly. An operator slidingly engages with the interior glass panel and is magnetically coupled with the follower carriage such that movement of the operator causes corresponding movement of the follower carriage. A spring holder is mounted to the operating-side rail. A spring is supported by the spring holder and is connected to the follower carriage to assist movement of the follower carriage in a first direction. The blinds-between-glass window assembly may also include a spring holder body with an axle mounted to the spring holder body and a coil spring mounted to the axle. The operating-side rail may include an operating-side exterior spacer plate and an operating-side interior spacer plate. The operating-side interior spacer plate may include an inner lip, an intermediate lip, and an outer lip that each extend generally perpendicularly from an operating-side interior spacer plate base plate. The outer lip, the base plate, and the intermediate lip may form a first channel. The intermediate lip, the base plate, and the inner lip may form a second channel. The spring holder may have a base mounted within the first channel and a body that extends from the spring holder base into the second channel through a notch in the intermediate lip. The operating side rail may include an operating-side exterior spacer plate and an operating-side interior spacer plate. A first clip may connect the operating-side interior spacer plate to the operating-side exterior spacer plate such that the interior-side and exterior-side spacer plates are held apart from each other without direct thermally conductive contact between the spacer plates.

According to another embodiment, the present invention is a blinds-between-glass window that includes an interior spacer plate fixed to an interior glass panel and an exterior spacer plate fixed to an exterior glass panel. A thermally insulating clip connects the interior and exterior spacers, such that the spacers are not in thermal contact with each other.

According to another embodiment, the present invention is a blinds-between-glass window that includes an interior glass panel and an exterior glass panel each fixed to opposite sides of a spacer assembly. A blind assembly operably attached to the spacer assembly at an interior portion between the glass panels. A rubber insert is attached to the spacer assembly between an inner surface of the frame and the blind assembly to prevent the blind assembly from directly contacting the inner surface of the frame. According to one embodiment, the insert is further located between the blind assembly and at least one of the glass panels to prevent the blind assembly from directly contacting the at least one of the glass panels.

According to another embodiment, the present invention is a blinds-between-glass window kit that includes an interior glass panel, an exterior glass panel, and of a spacer assembly. The spacer assembly includes an interior spacer plate to fix to the interior glass panel and an exterior spacer plate to be fixed to the exterior glass panel. A plurality of clips is provided to connect the interior spacer plate to the exterior spacer plate such that the spacer plates are spaced apart from each other. The plurality of clips includes clips of at least two different sizes such that the space between the interior and exterior glass panels can be adjusted depending upon which size clip is used to connect the glass panels.

DETAILED DESCRIPTION OF THE PREFERRED EMBODIMENTS

Figure 1:
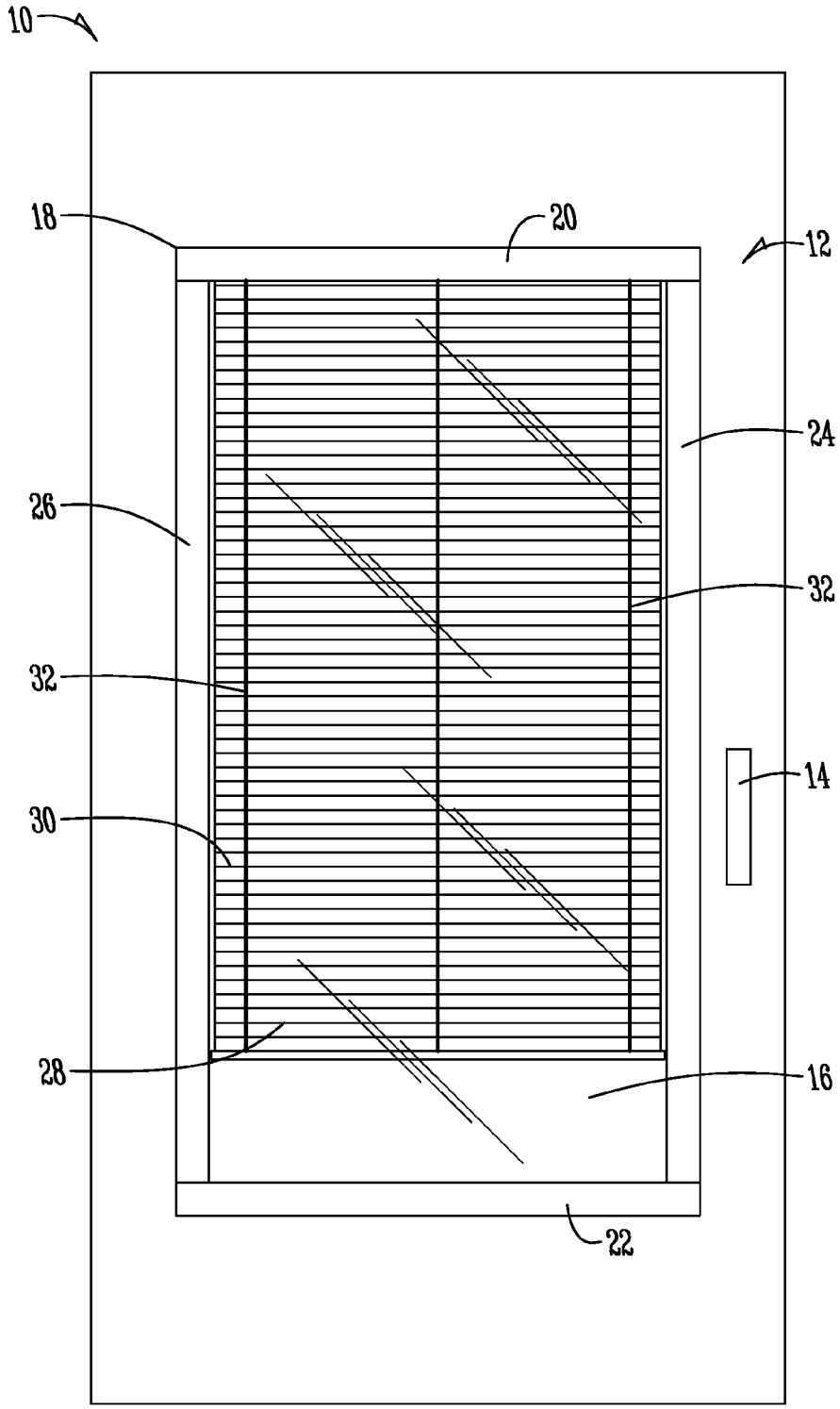
FIG. 1 is a front elevation view of a window assembly installed in a door, according one embodiment of the present invention.
Figure 2:
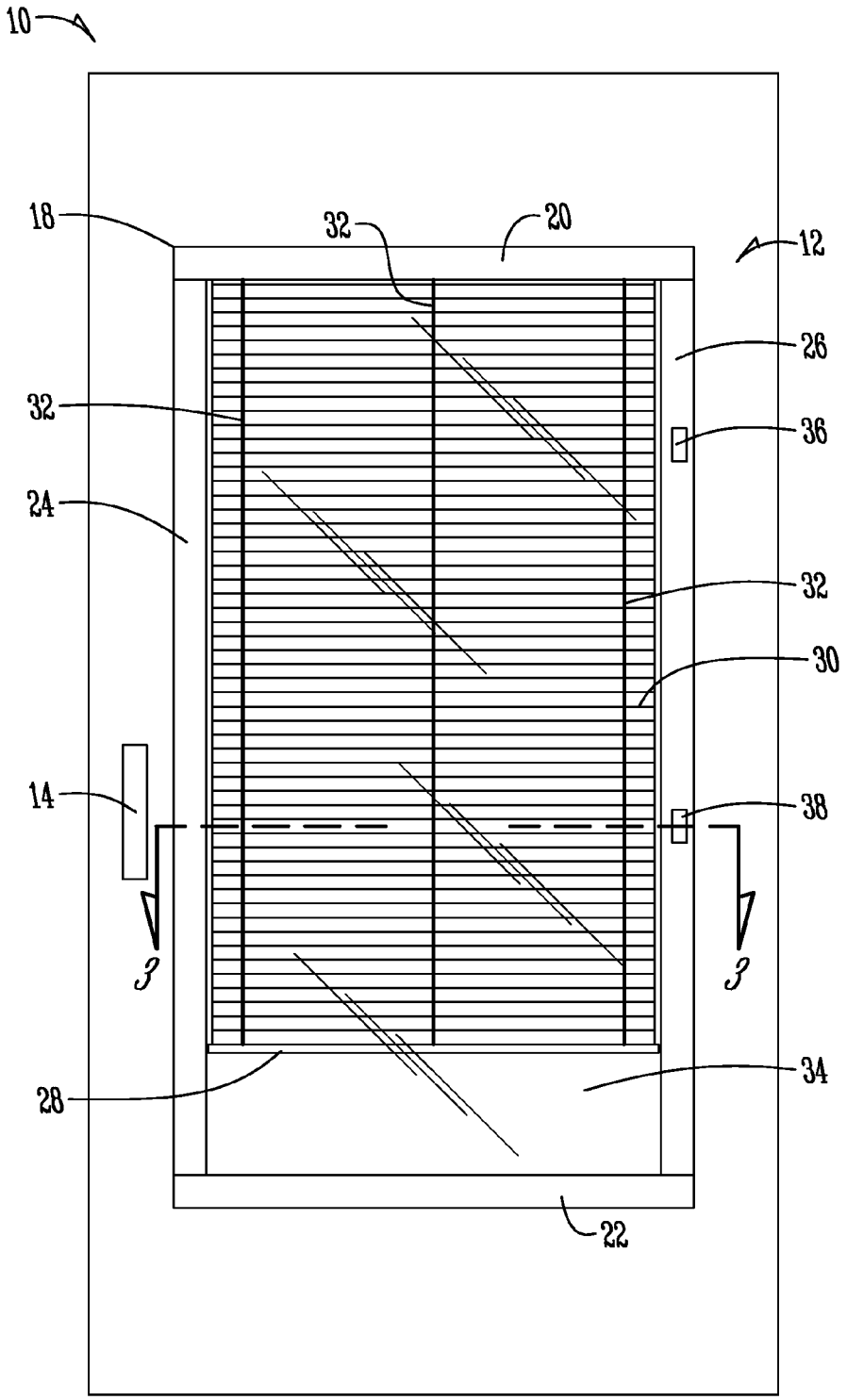
FIG. 2 is rear elevation view of the window assembly of FIG. 1.

FIGS. 1 and 2 show a door 10 that includes a window assembly 12 according to one embodiment of the present invention. FIG. 1 is a view of the door 12 from the exterior side, and FIG. 2 is a view of the door 10 from the interior side. The door 10 may be a standard hinged door, or a slider-type. A handle 14, or knob, may be included for opening and closing the door 10. As will be readily understood by those of skill in the art, the door 10 may be provided with hinges, rollers, or other accessories to properly mount the door 10. Additionally, the door 10 may be provided with a latching and locking mechanism. Furthermore, as will be readily understood from the following description, the window assembly 12 may be mounted in a stationary location, such as a wall, or virtually any other situation where a window assembly might be needed.

As seen in FIG. 1, the window assembly 12 includes an exterior glass panel 16. The exterior glass panel 16 is mounted to a generally rectangular frame 18. The frame 18 is formed from a top rail 20, a bottom rail 22, and side rails 24 and 26. A blind assembly 28 is mounted to the frame 18 behind the exterior glass panel 16. Side rail 26 will also be referred to herein as operating-side rail 26, because the mechanisms used to raise, lower, and tilt the blind assembly 28 are located within side rail 26. The blind assembly 28 may take several forms. Generally, the blind assembly 28 will include a plurality of slats 30 as well as at least one cord 32 for use in adjusting the slats 30. The adjustment of the slats 30 may include raising and lowering the slats 30, as well as adjusting the tilt of the slats 30. Alternatively, the blind assembly 28 may include an accordion-style blind (not shown), in which case no tilt adjustment would be necessary. As a further alternative, the blind assembly 28 might include vertical slats that are moved side-to-side rather than raised and lowered, and that rotate rather than tilt.

FIG. 2 shows the interior side of the door 10. An interior glass panel 34 is mounted to the frame 18 such that the frame 18 is provided between the glass panels 16 and 34. The blind assembly 28 is mounted to the frame 18 such that it is located within the space between the glass panels 16 and 34. The space between the glass panels 16 and 34 provides an insulating barrier across the window assembly 12, as well as providing a protected space for the blind assembly 28. As is commonly known, desiccant combinations, as well as inert gasses, such as argon or krypton, can be sealed within the space between the frame 18 and the glass panels 34 and 16 in order to resist heat transfer and prevent condensation on the interior of the glass panels 16 and 34. The glass panels 16 and 34 may be made from a variety of glasses, and may include surface treatments to control the amount and type of light that passes through the gas panels 34 and 16.

Magnetic operators 36 and 38 are provided on the operating-side rail 26. In the embodiment shown, the upper operator 36 is used to control the tilt of the slats 30 of the blind assembly 28, and the lower operator 38 is used to raise and lower the slats 30 of the blind assembly 28. The operators 36 and 38 are magnetically connected to followers (see elements 86 and 87, FIGS. 3-5) that are provided within the operating-side rail 26.

Figure 3:
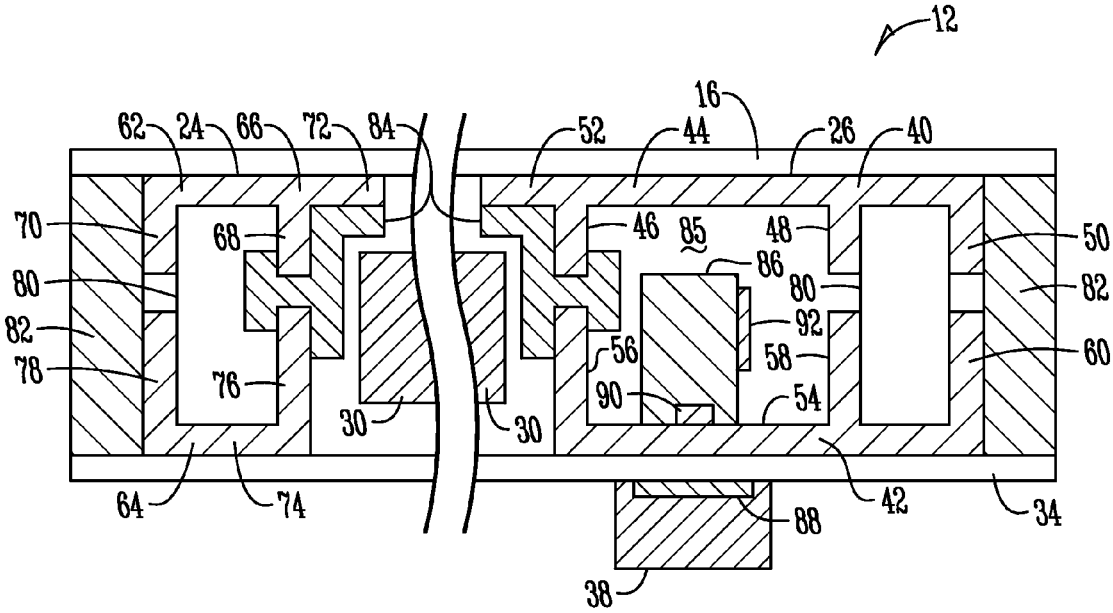
FIG. 3 is a partial broken cross-sectional view of the window assembly of FIG. 2, taken along line 3-3.

FIG. 3 is a broken cross-sectional view of the blinds-between-glass window assembly 12 shown in FIG. 2. As can be seen in FIG. 3, the operating-side rail 26 includes an operating-side exterior spacer plate 40 and an operating-side interior spacer plate 42. The spacer plates 40 and 42 are elongated plates that may be formed from any suitable window frame material, such as extruded aluminum. The operating-side exterior spacer plate 40 includes a flat base plate section 44 that includes three generally perpendicularly extending lips. The three lips are an inner lip 46, an intermediate lip 48, and an exterior lip 50. The inner lip 46 may be offset slightly from the inner edge of the base plate 44, such that a privacy lip 52 is formed at the inner portion of the spacer plate 40. The operating-side interior spacer plate 42 has a similar construction to the operating-side exterior spacer plate 40, except that the interior spacer plate 42 does not include the privacy lip 52. Specifically, the operating-side interior spacer plate 42 includes a base plate 54 with generally perpendicularly extending inner lip 56, intermediate lip 58, and outer lip 60.

The non-operating-side rail 24 includes a non-operating-side exterior spacer plate 62 and a non-operating-side interior spacer plate 64. The non-operating-side exterior spacer plate 62 is formed from a generally elongated base plate 66 that has generally perpendicularly extending inner lip 68 and outer lip 70. The inner lip 68 is offset from the inner edge of the base plate 66 to form a privacy lip 72 at the inner periphery of the non-operating-side exterior spacer plate 62. Similarly, the non-operating-side interior spacer plate 64 includes an elongated base plate 74 with generally perpendicularly extending inner lip 76 and outer lip 78.

The operating-side exterior spacer plate 40 is connected to the operating-side interior spacer plate 42 by a connector in the form of corner key 80 that is friction fit within channels formed between inner lip 48 and outer lip 50 and inner lip 58 and outer lip 60. Preferably, the key 80 is wide enough such that there is a gap between the lips 46, 48 and 50 of exterior spacer plate 40 and the lips 56, 58 and 60 of interior spacer plate 42. The gap between the operating-side spacer plates 40 and 42 represents a thermal break to reduce heat transfer across the window assembly. Preferably, the corner key will be formed from a material that is resistant to heat transfer. The lack of the direct metal conductivity across the window assembly greatly reduces the heat transfer across the assembly, and therefore improves energy efficiency.

A similar thermal break is provided between the non-operating-side exterior spacer plate 62 and the non-operating-side interior spacer plate 64 that form the non-operating-side rail 24. The non-operating-side spacer plates 62 and 64 are connected to each other and held apart from each other by a corner key 80 that is friction fit within the channels formed between inner lip 68 and outer lip 70 and between inner lip 76 and outer lip 78.

The side rails 24 and 26, having the construction described above, are sandwiched between the exterior-side glass panel 16 and the interior-side glass panel 34. The glass panels 16 and 34 are adhered or otherwise mounted to the side rails 24 and 26 in a known manner. The glass panels 16 and 34 extend beyond the outer perimeters of the side rails 24 and 26. A perimeter seal 82 is provided all the way around the perimeter of the rails 24 and 26 between the facing surfaces of the glass panel 16 and 34. This perimeter seal 82 provides a complete perimeter wrap of the assembly to prevent moisture absorption into the assembly.

The blind slat 30 are provided within the space surrounded by the interior and exterior glass panels 34 and 16, and the inner lips 46, 56, 68, and 76 of the spacer plates 40, 42, 62, and 64. Preferably, the blind slats 30 extend laterally so that they slightly overlap the privacy lips 52 and 72 provided on the exterior spacer plates 40 and 62. In order to avoid scratching or marring of the blind slats 30 or the side rails 24 and 26, that could occur, especially in dynamic installations such as doors, as the blind slats 30 move around within the space between the glass panels 16 and 34, scratch guards 84 may be provided at the interior of the side rails 24 and 26. These scratch guards 84 may be friction fit within the gap between the inner lips 68 and 76 of the non-operating-side rail 24 and the inner lips 46 and 56 of the operating-side rail 26. The scratch guards 84 may be spaced out vertically along the extent of the side rails 24 and 26, or may be elongated elements that extend as a single piece generally along most of the length of the side rails 16 and 24. In addition to preventing scratching or marring, the scratch guards may reduce the noise that occurs from contact between the blind slats 30 and the metallic spacer plates 40, 42, 62, and 64. Preferably, the scratch guard 84 may be formed from a clear rubber or rubberized material.

An operating space 85 is provided within the operating-side rail 26. The operating space 85 is generally bounded by the base plate 44, inner lip 46, and intermediate lip 48 of the operating-side exterior spacer plate 40 on one side and the inner lip 46 base plate 54 and intermediate lip 58 of the operating-side interior spacer plate 42 on the other. A follower carriage 86 is provided within the operating space 85 to slide up and down along an inner surface of the base plate 54 of the operating-side interior spacer plate 42. The follower carriage 86 is magnetically coupled to operator 38 that slides against the outer surface of interior glass panel 34. The operator 38 includes a magnetic coupling element 88 that is magnetically attracted to a second magnetic coupling element 90 provided within the follower carriage 86. The attraction between the two magnetic coupling elements 88 and 90 operably connects the carriage follower 86 with the operator 38. Therefore, manual adjustment upwardly and downwardly of the operator 38 causes corresponding movement by the follower carriage 86. While not visible in FIG. 3, it should be understood that follower carriage 86 is connected by a cord or other known connections, to the blind assembly 28 in order to raise and lower the blinds as desired. A coil spring 92 is attached to the follower carriage 86, in order to counter balance the follower carriage 86. The details of the coil spring 92, and the mounting mechanism for providing counter balance are best seen in FIGS. 4 and 5.

The overall thickness of the assembly can be varied by choosing corner keys 80 of varying widths. This is advantageous because it makes the assembly highly modular. Almost all of the same pieces can be used to form window assemblies of different thicknesses. Furthermore, the thickness of the assembly can be adjusted to fit a desired location, with different thicknesses of glass panels used, by simply varying the width of the corner keys 80. The modular nature and flexibility achieved by the ability to vary thickness by simply changing corner keys 80 makes the above described system highly economical.

Figure 4:
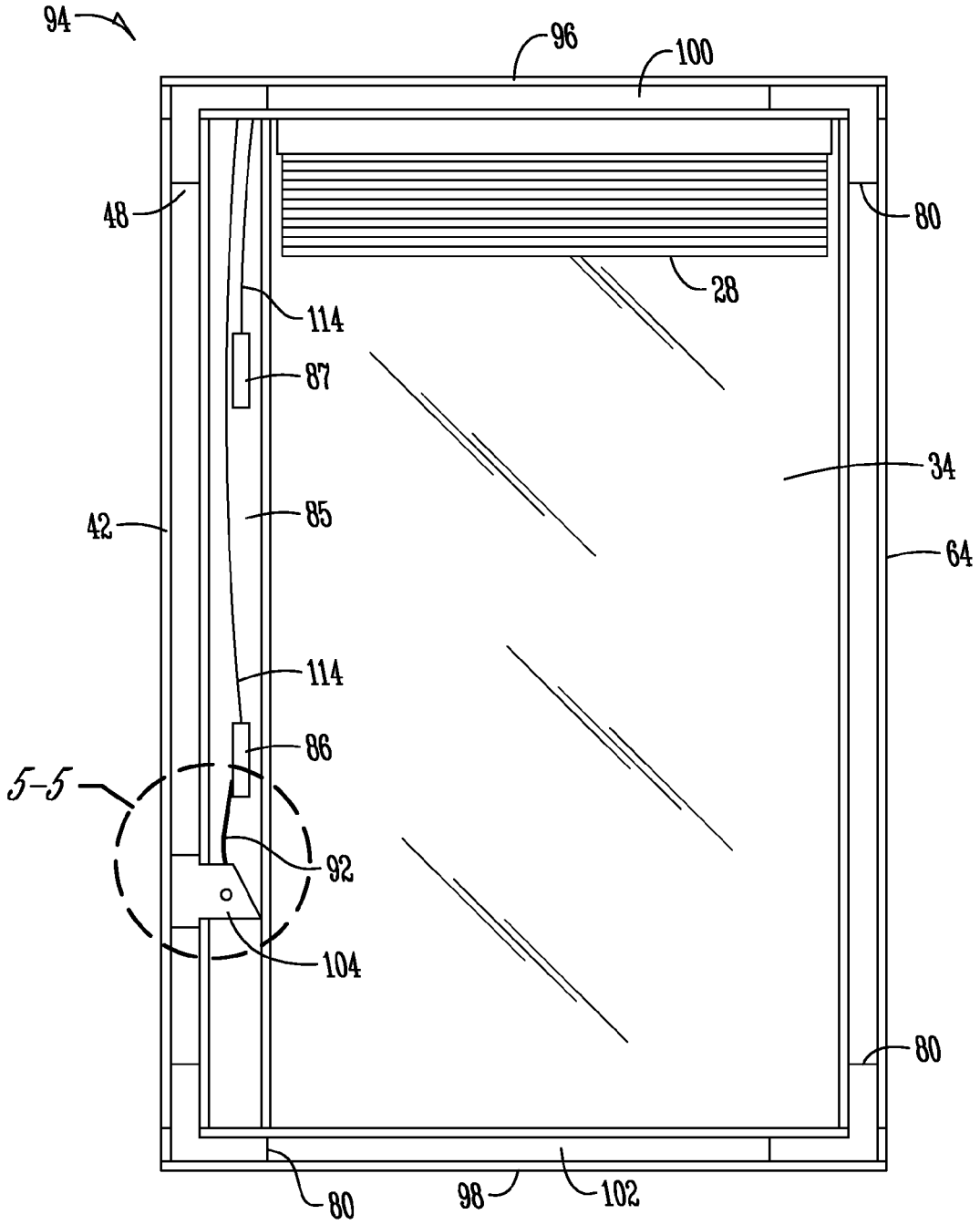
FIG. 4 is a plan view of a partially assembled window assembly according to one embodiment of the present invention.
Figure 5:
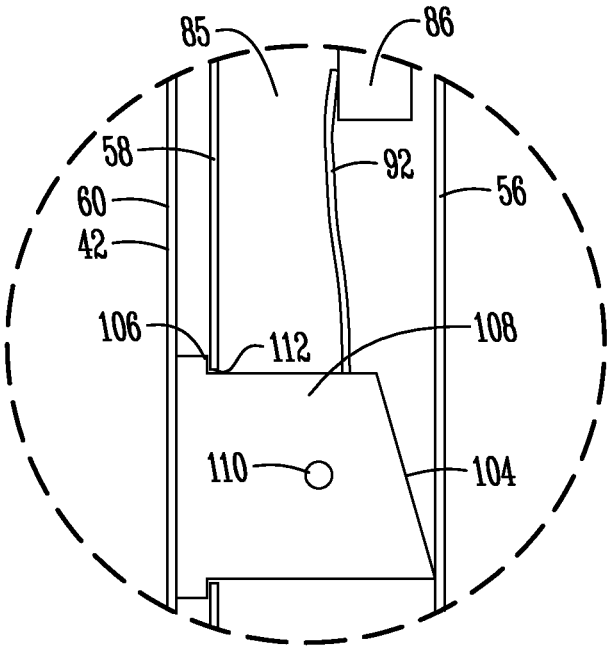
FIG. 5 is an enlarged detail view of the coil spring counterbalance mechanism from the assembly of FIG. 4.

FIG. 4 shows an intermediate assembly 94 used in forming the window assembly 12 described above. Basically, the intermediate assembly 94 includes all of the parts of assembly 12, except for the exterior spacer plates 40 and 62 and the exterior glass panel 16. The intermediate assembly 94 includes an outer frame formed by operating-side interior spacer plate 42, non-operating-side interior spacer plate 64, top interior spacer plate 96, and bottom interior spacer plate 98. The interior spacer plates 42, 96, 64, and 98 are all connected to each other by corner keys 80. Corner keys 80 are friction fit within channels 100 and 102 formed within the top and bottom interior spacer plates 96 and 98, respectively. The corner keys 80 are also friction fit within channels formed between the lips of the operating-side and non-operating-side spacer plates 42 and 64, as shown in FIG. 3. An adhesive or mechanical fastener may also be used in addition to the friction fit to connect the corner keys 80 with the spacer plates 42, 96, 64, and 98.

The follower carriage 86 is used to adjust the blind assembly 28 vertically. A tilt follower 87 used to adjust the tilt of the blinds. The followers 86 and 87 are provided within the operational space 85 within the operating-side interior spacer plate 42. The followers 86 and 87 are operably connected to the blind assembly 28 via cords 114. A coil spring support 104 is attached to the operating-side interior spacer plate 42. The spring support 104 supports coil spring 92 that attaches to follower carriage 86. The coil spring support 104 and coil spring 92 are used to provide a counter balance against the weight of the blind assembly 28 that pulls against the follower carriage 86 through cord 114. Specifically, the spring 92 is biased to urge the follower downwardly to counteract the tension in cord 114 caused by the weight of the blind slats 30. The details of the spring support 104 can be better seen in the enlarged partial view of FIG. 5.

As seen in FIG. 5, the spring support 104 includes a base portion 106 and a body portion 108. The body portion 108 may be hollow, or may include a pair of generally parallel walls. An axle 110 is mounted to the support body 108 to support coil spring 92, which is coiled around axle 110. The base 106 of the support 104 may be wider than the body 108 in order to be retained within the channel formed between lips 58 and 60 of the operating-side interior spacer plate 42. A notch 112 may be provided through the intermediate lip 58 in order to permit the body portion 108 of the spring support 104 to extend into the operating space 85 of the operating-side interior spacer plate 42. The notch 112 also serves to restrain the support 104 from vertical movement. Alternatively, or in addition to such restraint, a fastener, such as a threaded fastener and nut, could be used to secure the spring holder 104 to the operating-side interior spacer plate 42.

A preferred manner of assembling the window assembly 12 is to first make the intermediate assembly 94 shown in FIG. 4. To accomplish this, the interior glass panel 34 is laid on a flat horizontal working surface, such as a work bench or table top. The interior side frame is then formed by connecting the interior spacer plates 42, 96, 64 and 98 using the corner keys 80. The connected interior spacer plates 42, 96, 64 and 98 are then placed on top of the interior glass panel 34 with their base sides down and their lip sides facing up. The blind assembly 28 is then attached to the top interior spacer plate 96 in a conventional fashion. The cords 114 are fed through notches formed in the top interior spacer plate 96 through channel 100 into the operating space 85 formed in operating-side interior spacer plate 42. A stringer or pulley may be used to guide the cords 114 between the spacers and to reduce friction, which can make operation of the blind assembly 28 difficult and can cause wear on the cords 114. One of the cords 114 is operably attached to tilt follower 87 within the operating space 85. Movement of the tilt follower 87 is transmitted to the blind assembly 28 by the attached cord 114, which causes adjustment of the tilt angle of the slats of the blind assembly 28. The open configuration of the intermediate assembly 94 allows for convenient access to all the components for adjustment and testing of the tilt function prior to final assembly.

The coil spring support 104 is located within notch 112 (see FIG. 5) of the operating-side interior spacer plate 42 with the coil spring 92 extending from the spring support 104 towards the top of the assembly to the attached follower carriage 86. The coil spring 92 is retractably wound around axle 110 of the support 104, and in operation provides a counterbalancing force that reduces the tension in cord 114. The user can adjust the cord 114 attached to carriage follower 86 to assure that adjustment of the carriage follower 86 within the operating space 85 causes up and down adjustment of the blind assembly 28 as desired. The open configuration of the intermediate assembly 94 makes adjustment of the up and down mechanism convenient.

Once the user verifies that the tilt and raise-and-lower mechanisms are properly adjusted, the exterior spacer plates 40, 62, and top and bottom exterior spacer plates (not shown) can be secured to the intermediate assembly 94 by snapping them into position with their lips 70, 68, 48, and 50 in engagement with the corner keys 80. Those of skill in the art will also appreciate that a small number of support tabs, in the form of tabs that are friction fit within the channels formed by the lips of the spacer plates may also be provided to provide additional connection of the spacer plates to each other. Additionally, if desired, prior to snapping the exterior-side spacer plates 40 and 62 into place on the intermediate assembly 94, scratch guards 84 may be attached to the inner lips 46 and 68 of the exterior spacer plates 40 and 62. The scratch guards 84 may also be engaged by inner lips 56 and 76 of the interior side spacer plates 42 and 64 once snapped into place on the intermediate assembly 94. The ultimate placement of the scratch guards 84 can be best seen in FIG. 3.

With the exterior-side spacer plates 40 and 62 snapped into place, the exterior glass panel 16 can be laid flat onto the exterior spacer plates 40 and 62 and the corresponding exterior top and bottom spacer plates (not shown). Clamps can be applied to the glass panels 34 and 16 to hold the assembly together. The operators 36 and 38 can be placed with their magnetic sides facing the interior glass panel 34 in alignment with the followers 86 and 87. The clamped together assembly can then be lifted into a vertical orientation in order to test the operation of the raise and lower and tilt functions and the alignment of the blind slats 30. If any adjustments are necessary, the assembly can be laid flat, unclamped, and the necessary adjustments made. Once the mechanisms are properly adjusted, the perimeter seal 82 can be applied around the entire assembly. The seal, as well as any adhesives for attaching the glass panels 16 and 34 to the spacer plates, are allowed to cure to form the final window assembly 12.

The completed window assembly 12 may be placed in a working environment, such as a door 10, as shown in FIGS. 1 and 2. Alternatively, the completed window assembly 12 may be used in a stationary mounting, such as within a wall.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A window assembly comprising:

a frame assembly, the frame assembly including an operating-side rail, a non-operating-side rail, a top rail and a bottom rail, the operating-side rail being connected to the top rail by a first corner clip and being connected to the bottom rail by a second corner clip, the non-operating side rail being connected to the top rail by a third corner clip and being connected to the bottom rail by a fourth corner clip;

an interior glass panel mounted to the frame assembly at an interior side of the frame assembly;

an exterior glass panel mounted to the frame assembly at an exterior side of the frame assembly opposite from the interior side;

a blind assembly operably attached to the top rail between the glass panels;

a follower carriage retained within the operating-side rail, the follower carriage being operably connected to the blind assembly such that movement of the follower carriage within the operating-side rail in a first direction causes adjustment of the blind assembly towards an open configuration and movement of the follower carriage within the operating-side rail in a second direction causes adjustment of the blind assembly towards a closed configuration;

an operator magnetically coupled to the follower carriage at the interior glass panel, whereby movement of the operator causes corresponding movement of the follower carriage;

a spring holder mounted within the operating-side rail; and a spring mounted to the spring holder, the spring being connected to the follower carriage, the spring being biased to urge the follower carriage towards the first direction; and wherein:

the operating-side rail includes an operating-side exterior spacer plate and an operating-side interior spacer plate, the operating-side interior spacer plate being held apart from the operating-side exterior spacer plate by the first and second corner clips whereby the operating-side interior spacer plate is not in direct thermally conductive contact with the operating-side exterior spacer plate and wherein the operating-side interior spacer plate includes an inner lip, an intermediate lip, and an outer lip that each extend generally perpendicularly from an operating-side interior spacer plate base plate, wherein a first channel is formed by the outer lip, the base plate, and the intermediate lip, and wherein a second channel is formed by the intermediate lip, the base plate, and the inner lip, and wherein the spring holder includes a spring holder base mounted within the first channel and a spring holder body that extends into the second channel, the spring holder body extending through a notch in the intermediate lip; and the non-operating-side rail includes a non-operating-side exterior spacer plate and a non-operating-side interior spacer plate, the non-operating-side interior spacer plate being held apart from the non-operating-side exterior spacer plate by the third and fourth corner clips whereby the non-operating-side interior spacer plate is not in direct thermally conductive contact with the non-operating-side exterior spacer plate.

2. The window assembly of claim 1, wherein the spring holder includes a spring holder body with an axle, and wherein in the spring is a coil spring mounted to the axle.

3. The window assembly of claim 2, wherein the coil spring urges the follower carriage downwardly to counterbalance an upward force against the follower carriage caused by a cord connected to the blind assembly.

4. The window assembly of claim 1, further comprising:

a first guard member connected at an inner edge of the operating-side exterior spacer plate between the operating side exterior spacer plate and the blind assembly to prevent the blind assembly from directly contacting the operating side exterior spacer plate;

a second guard member connected at an inner edge of the non-operating-side exterior spacer plate between the non-operating side exterior spacer plate and the blind assembly to prevent the blind assembly from directly contacting the non-operating side exterior spacer plate.

5. The window assembly of claim 1. wherein the interior glass panel and the exterior glass panel extend outwardly beyond an outer perimeter of the frame assembly, the window assembly further comprising:

a perimeter seal that completely covers and seals the outer perimeter of the frame assembly and is between the interior and exterior glass panels.

6. The window assembly of claim 1, wherein:

the operating-side exterior spacer plate is mounted at an interior-facing surface of the exterior glass panel; and the operating-side interior spacer plate is mounted at an exterior-facing surface of the interior glass panel.

7. A blinds-between-glass window assembly comprising:

a frame, the frame including an operating-side rail including an operating-side exterior spacer plate and an operating-side interior spacer plate, a non-operating-side rail, a top rail, and a bottom rail, the operating-side interior spacer plate including an inner lip, an intermediate lip and an outer lip that each extend generally perpendicularly from an operating-side interior spacer plate base plate;

an interior glass panel mounted at one side of the frame;

an exterior glass panel spaced apart from the interior glass panel and mounted at an opposite side of the frame such that an insulated space is provided between the interior glass panel and the exterior glass pane;

a blind assembly operationally mounted to the frame within the insulating space;

a follower carriage within the operating side rail operably connected to the blind assembly such that movement of the follower carriage causes adjustment of the blind assembly;

an operator slidingly engaged with the interior glass panel, the operator being magnetically coupled with the follower carriage such that movement of the operator causes corresponding movement of the follower carriage;

a spring holder mounted to the operating side rail, the spring holder including to spring holder body and an axle mounted to the spring holder body, and wherein the spring is a coil spring mounted to the axle; and a spring supported by the spring holder, the spring being connected to the follower carriage to assist movement of the follower carriage in a first direction; and wherein a first channel is formed by the outer lip, the base plate. and the intermediate lip;

a second channel is formed by the intermediate lip, the base plate, and the inner lip;

the spring holder includes a spring holder base mounted within the first channel;

the spring holder body extends from the spring holder base into the second channel;

a notch is provided in the intermediate lip; and the spring holder body extends through the notch in the intermediate lip.

8. The blinds-between-glass window assembly of claim 7, wherein a first clip connects the operating-side interior spacer plate to the operating-side exterior spacer plate such that the interior-side and exterior-side spacer plates are held, apart from each other without direct thermally conductive contact between the spacer plates.

9. The blinds-between-glass window assembly of claim 7, wherein:

the interior glass plate includes an exterior-facing surface and an interior-facing surface, and wherein the operating-side interior spacer plate is mounted to the exterior facing surface of the interior glass panel; and the exterior glass panel includes an exterior-facing surface and an interior-facing surface, and wherein the operating-side exterior spacer plate is mounted to the interior facing surface of the exterior glass panel.

* * * * *